US012270200B2

(12) United States Patent
Imai et al.

(10) Patent No.: US 12,270,200 B2
(45) Date of Patent: Apr. 8, 2025

(54) PARTITION

(71) Applicant: DAIKIN INDUSTRIES, LTD., Osaka (JP)

(72) Inventors: Yousuke Imai, Osaka (JP); Takamune Okui, Osaka (JP); Chizuru Murakami, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/383,693

(22) Filed: Oct. 25, 2023

(65) Prior Publication Data

US 2024/0052628 A1 Feb. 15, 2024

Related U.S. Application Data

(63) Continuation of application No. PCT/JP2022/018449, filed on Apr. 21, 2022.

(30) Foreign Application Priority Data

Apr. 27, 2021 (JP) ..... 2021-075239

(51) Int. Cl.
*E04B 2/74* (2006.01)
*F24F 7/007* (2006.01)
(Continued)

(52) U.S. Cl.
CPC ..... *E04B 2/74* (2013.01); *F24F 7/007* (2013.01); *F24F 8/80* (2021.01); *F24H 3/04* (2013.01)

(58) Field of Classification Search
CPC .... F24F 8/80; F24F 7/007; E04B 2/74; F24H 3/04
(Continued)

(56) References Cited

U.S. PATENT DOCUMENTS 3,722,580 A * 3/1973 Braver ..... F24F 1/005 62/263
4,860,642 A * 8/1989 Nussbaum ..... F24F 1/00 454/306
(Continued)

FOREIGN PATENT DOCUMENTS

CN 204461000 U 7/2015
CN 105444387 A 3/2016
(Continued)

OTHER PUBLICATIONS

International Preliminary Report of corresponding PCT Application No. PCT/JP2022/018449 dated Nov. 9, 2023.
(Continued)

*Primary Examiner* — Avinash A Savani
*Assistant Examiner* — Dana K Tighe
(74) *Attorney, Agent, or Firm* — GLOBAL IP COUNSELORS, LLP

(57) ABSTRACT

A partition has an air blowing function of blowing air to a predetermined region. The partition includes a casing, a blower mechanism arranged in the casing, and a blow-out port formed in the casing. On a virtual plane facing the blow-out port and having a wind velocity of 0.2 m/s or more, an airflow with an average momentum per unit area from 0.05 kg/ms$^2$ to 0.75 kg/ms$^2$ is generated.

13 Claims, 13 Drawing Sheets

(51) Int. Cl.
*F24F 8/80* (2021.01)
*F24H 3/04* (2022.01)

(58) Field of Classification Search
USPC ..... 454/186, 187, 188, 236
See application file for complete search history.

(56) References Cited

U.S. PATENT DOCUMENTS

| | | | | | |
|---|---|---|---|---|---|
| 5,264,015 | A * | 11/1993 | Matsui | F24F 1/0071 | 55/467 |
| 6,481,228 | B1 * | 11/2002 | Chiang | F24F 1/0035 | 62/223 |
| 7,334,424 | B2 * | 2/2008 | Park | F24F 1/005 | 62/428 |
| 7,615,106 | B2 * | 11/2009 | Yasukawa | A61L 9/22 | 96/57 |
| 9,310,088 | B2 * | 4/2016 | Melikov | G16H 50/80 | |
| 2004/0192186 | A1 * | 9/2004 | Bourgeois | B01D 46/12 | 55/385.2 |
| 2020/0378625 | A1 | 12/2020 | Imai et al. | | |
| 2022/0010989 | A1 * | 1/2022 | Smith | F24F 7/003 | |
| 2022/0205448 | A1 | 6/2022 | Fujita et al. | | |

FOREIGN PATENT DOCUMENTS

| | | | |
|---|---|---|---|
| CN | 111699322 | A | 9/2020 |
| JP | 6-307707 | A | 11/1994 |
| JP | 2019-13287 | A | 1/2019 |
| JP | 6603874 | B2 | 10/2019 |
| WO | 2019/163934 | A1 | 8/2019 |
| WO | 2021/054362 | A1 | 3/2021 |

OTHER PUBLICATIONS

International Search Report of corresponding PCT Application No. PCT/JP2022/0181449 dated Jun. 28, 2022.
European Search Report of corresponding EP Application No. 22 79 5670.3 dated Jun. 14, 2023.

* cited by examiner 1
1
1
S
1
1
1

PARTITION

CROSS-REFERENCE TO RELATED APPLICATIONS

This is a continuation of International Application No. PCT/JP2022/018449 filed on Apr. 21, 2022, which claims priority to Japanese Patent Application No. 2021-075239, filed on Apr. 27, 2021. The entire disclosures of these applications are incorporated by reference herein.

BACKGROUND

Technical Field

The present disclosure relates to a partition.

Background Art

Japanese Unexamined Patent Publication No. 2019-013287 discloses a simple partition which can be easily arranged according to the size of a place where the partition is to be used, and has improved usability.

SUMMARY

A first aspect of the present disclosure is directed to a partition having an air blowing function of blowing air to a predetermined region. The partition includes a casing, a blower mechanism arranged in the casing, and a blow-out port formed in the casing. On a virtual plane facing the blow-out port and having a wind velocity of 0.2 m/s or more, an airflow with an average momentum per unit area from 0.05 kg/ms$^2$ to 0.75 kg/ms$^2$ is generated.

DETAILED DESCRIPTION OF EMBODIMENT(S)

Embodiments of the present disclosure will be described with reference to the drawings. The following embodiments are merely exemplary ones in nature, and are not intended to limit the scope, application, or uses of the invention. Features of the embodiments, variations, and other examples described below can be combined or partially substituted within the range where the present invention can be embodied.

EMBODIMENTS

Figure 1:
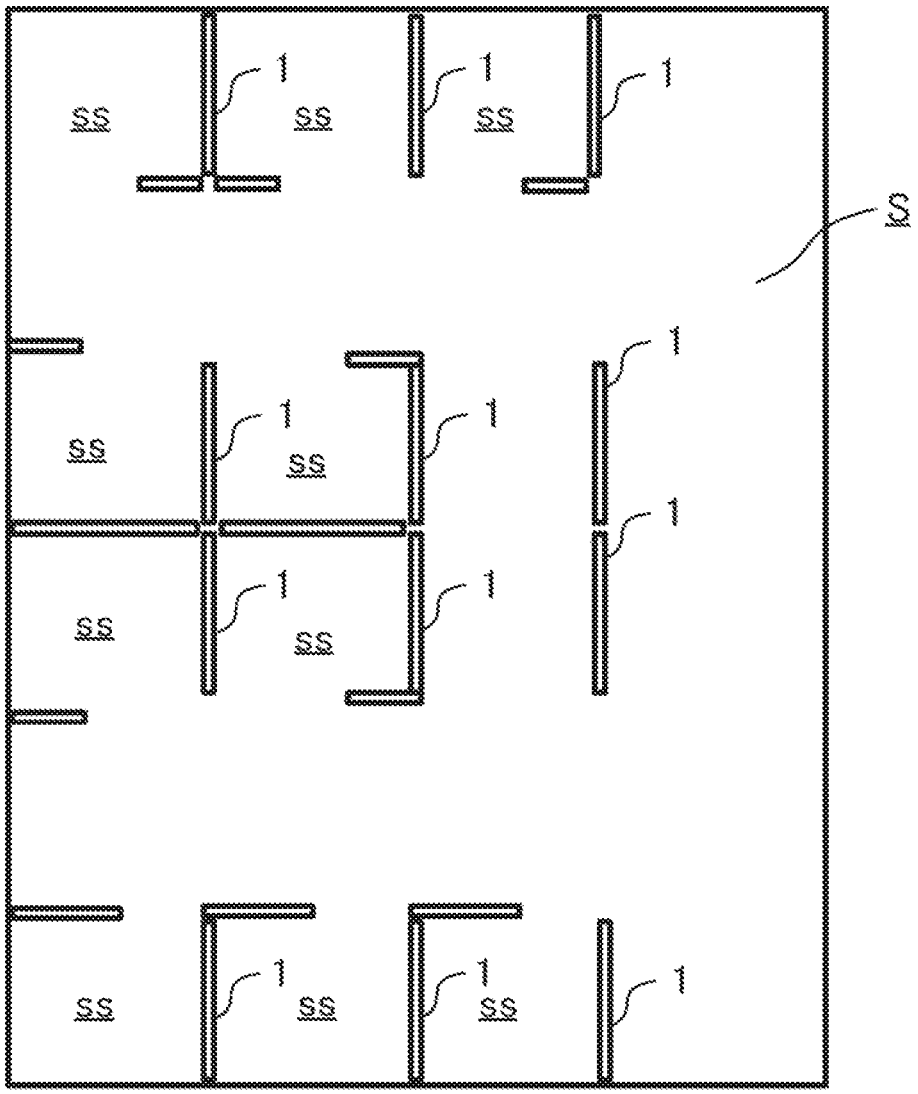
FIG. 1 is a view of an indoor space, where partitions of an embodiment are arranged, from above.

As illustrated in FIG. 1, partitions (1) of this embodiment are arranged in an indoor space (S) such as an office or a conference room. The partitions (1) partition the indoor space (S) to form a plurality of small spaces (ss). The small space (ss) is a predetermined space of the present disclosure. The partition (1) of this embodiment is portable. In the indoor space (S), a user changes the positions of the partitions (1) or combines a plurality of partitions (1) according to the positions, the numbers, and the sizes of the small spaces (ss).

Configuration of Partition

Figure 2:
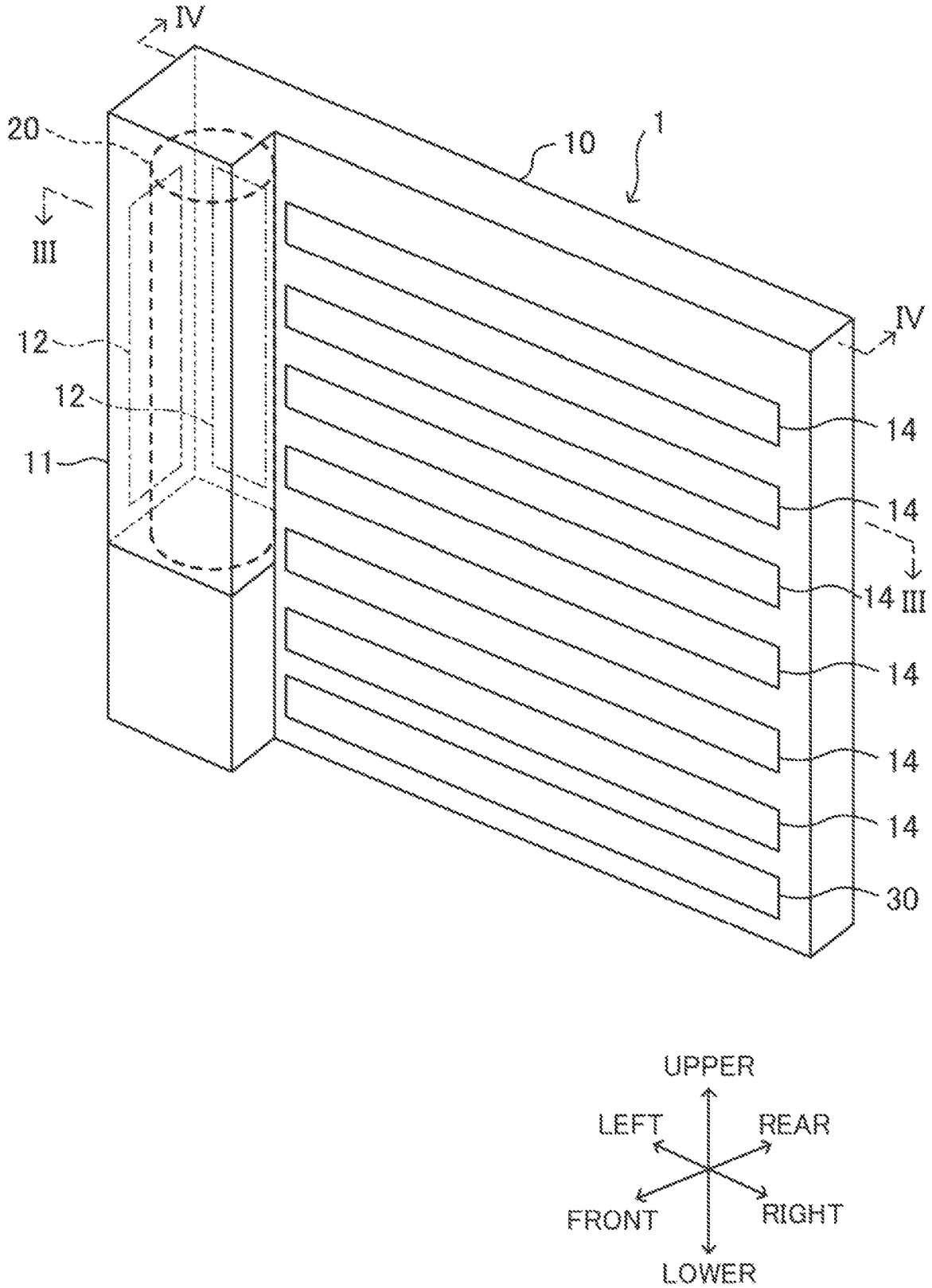
FIG. 2 is a three-dimensional perspective view illustrating the configuration of the partition.

As illustrated in FIG. 2, the partition (1) has a casing (10), a blower fan (20), and a heater (30).

Casing

Hereinafter, the terms "upper," "lower," "left," "right," "front," and "rear" used in description of the casing (10) refer to directions as viewed in FIG. 2 (directions when the casing (10) is viewed from the front).

Figure 3:
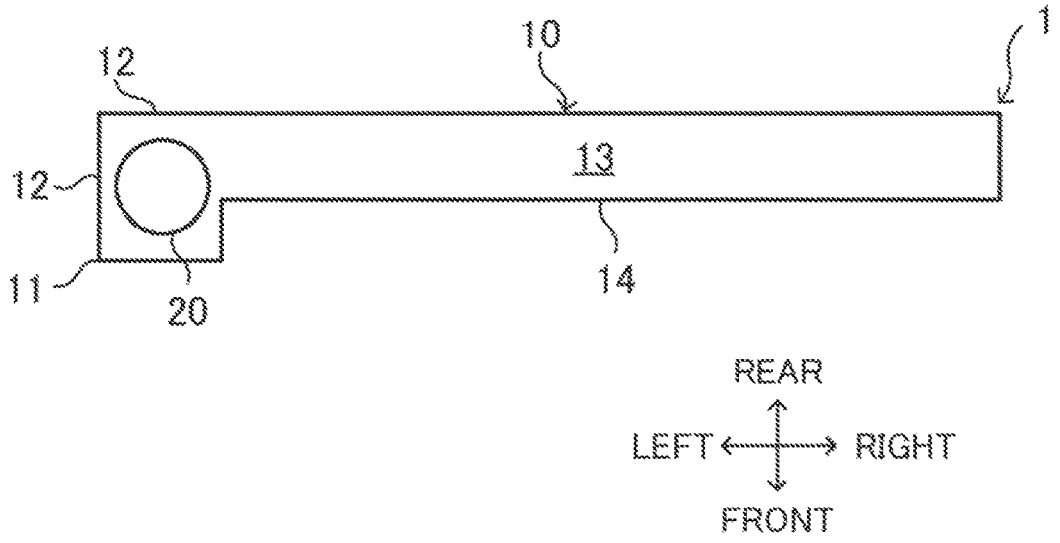
FIG. 3 is a view illustrating the section of the partition of FIG. 2 taken along line III-III.
Figure 4:
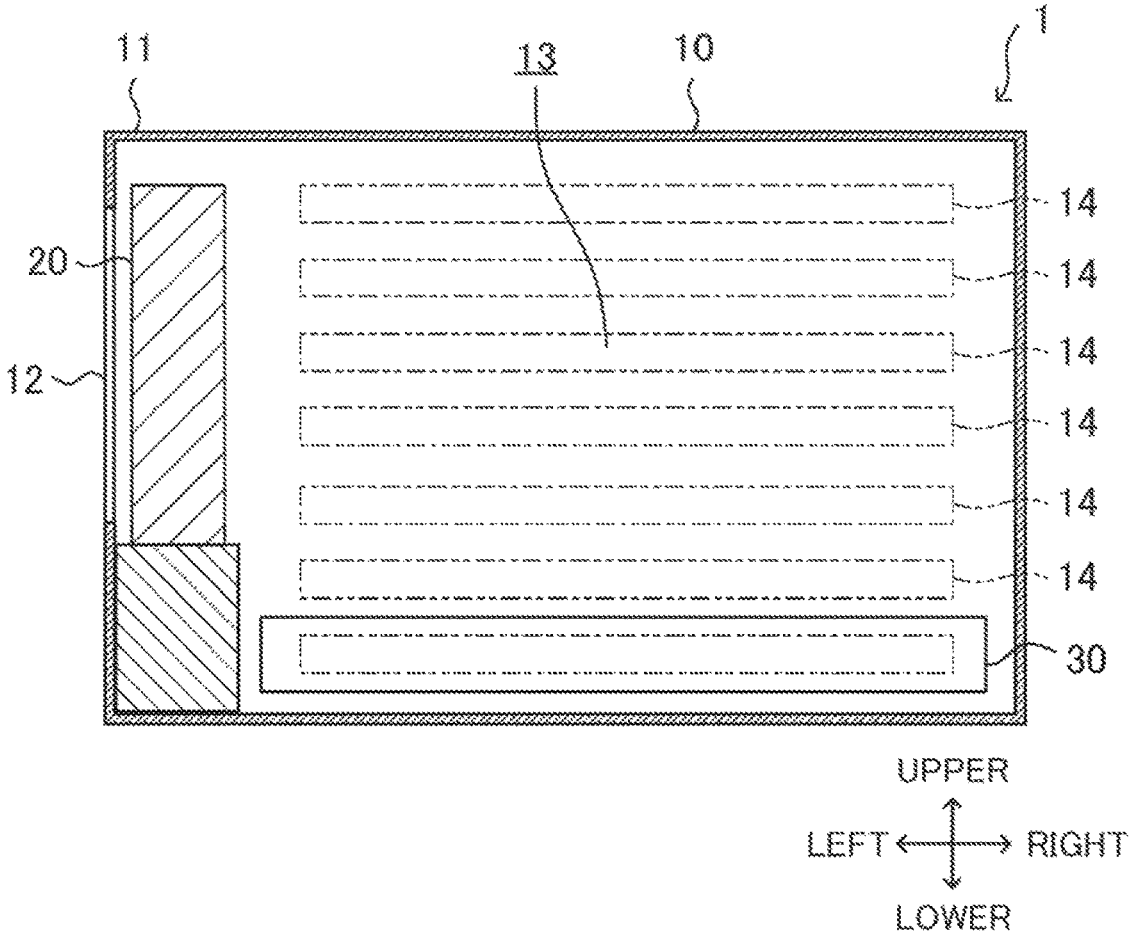
FIG. 4 is a view illustrating the section of the partition of FIG. 2 taken along line IV-IV.

As illustrated in FIGS. 2 to 4, the casing (10) is formed in a rectangular parallelepiped shape having a relatively short depth in the front-rear direction. Specifically, the casing (10) has a fan storing portion (11), suction ports (12), an air passage (13), and blow-out ports (14).

The fan storing portion (11) stores the blower fan (20). The fan storing portion (11) is provided at the left end of the casing (10). The fan storing portion (11) is formed in a substantially tubular shape extending in the upper-lower direction.

The suction ports (12) are formed in the rear surface and left surface of the fan storing portion (11) (indicated by chain double-dashed lines in FIG. 2). The suction port (12) is formed vertically long. Air in the indoor space (S) is sucked into the blower fan (20) through the suction ports (12).

The blower fan (20) is a blower mechanism (20) of the present disclosure. The blower fan (20) is, for example, a cross-flow fan. The blower fan (20) is arranged so as to extend in the upper-lower direction in the fan storing portion (11) (indicated by a broken line in FIG. 2). The blower fan (20) is arranged at the inflow end of the air passage (13). The blower fan (20) delivers air to the air passage (13).

The air passage (13) is a space through which air passes from the blower fan (20) to the blow-out ports (14). Specifically, the air passage (13) extends in the right-left direction and also extends in the upper-lower direction in the casing (10). The blower fan (20) arranged at the left end of the air passage (13) causes air to flow rightward in the air passage (13). In this example, the right direction is a first direction of the present disclosure. When the base end of the air passage (13) is at the position of the blower fan (20), the tip end of the air passage (13) is closed by the right surface of the casing (10).

The blow-out ports (14) are formed along the air passage (13). Specifically, the blow-out ports (14) are formed in the front surface of the casing (10) (indicated by chain double-dashed lines in FIG. 4). The blow-out ports (14) are formed such that a plurality of slit-shaped openings extending in the right-left direction are arranged in the upper-lower direction. The blow-out port (14) is provided with a rectifying member (40).

Rectifying Member

Figure 5:
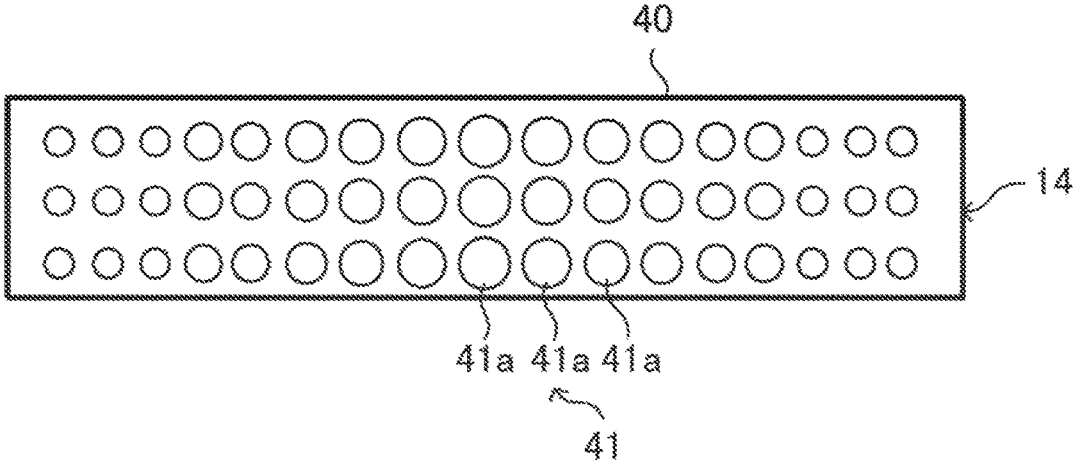
FIG. 5 is a view of a rectifying member from the front.

As illustrated in FIG. 5, the partition (1) has the rectifying members (40). The rectifying member (40) is provided at the opening of each blow-out port (14). The rectifying member (40) is provided over the entire opening of the blow-out port (14), and makes a uniform flow direction of air blown out through the blow-out port (14).

The rectifying member (40) has a porous portion (41) formed with a plurality of holes (41*a*). The rectifying member (40) is, for example, a punching metal. The porous portion (41) is formed such that the opening area of the hole (41*a*) gradually decreases from an intermediate position toward both ends of the air passage (13) in the lateral direction (right direction) thereof. The maximum opening area of the hole (41*a*) of the porous portion (41) is about 1.5 times as large as the minimum opening area.

Heater

As illustrated in FIGS. 2 and 4, the partition (1) has the heater (30). The heater (30) is, for example, a far infrared heater. The heater (30) is a heat supply device (30) of the present disclosure. The heater (30) is arranged in a lower portion of the casing (10). The heater (30) is arranged so as to extend in the right-left direction. The heater (30) is exposed to the small space (ss) in the lower portion of the casing (10).

Controller

Figure 6:
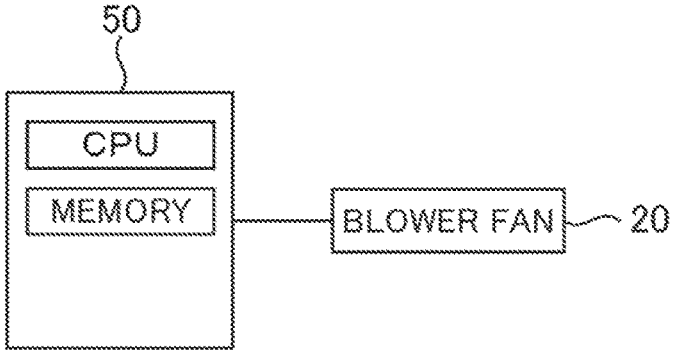
FIG. 6 is a block diagram illustrating the configuration of a controller.

As illustrated in FIG. 6, the partition (1) includes a controller (50). The controller (50) includes a CPU that executes a control program, and a memory that stores the control program, data necessary for executing the control program, etc.

The controller (50) controls the number of rotations of the blower fan (20). By controlling the number of rotations of the blower fan (20), an airflow generated by air blown out through the blow-out ports (14) is adjusted so as to irregularly change within a predetermined range of momentum. Details will be described below.

Control of Blower Fan

Figure 7:
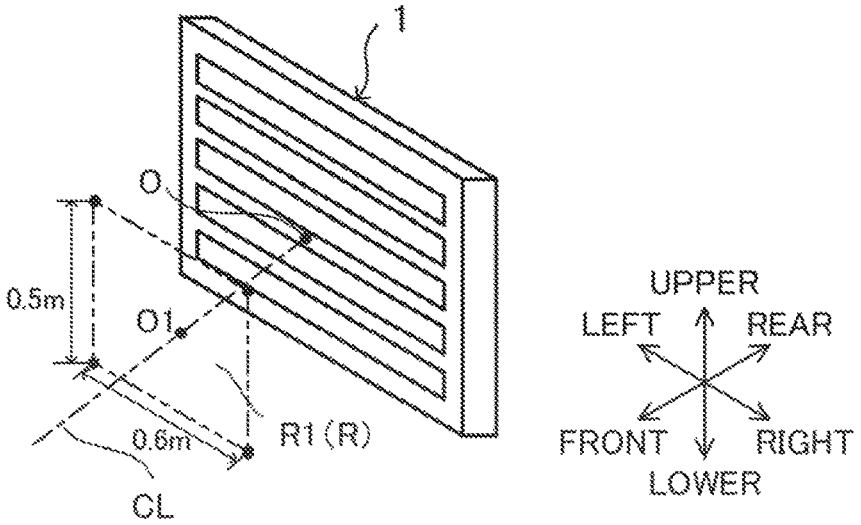
FIG. 7 is a view illustrating a virtual plane on which an airflow is generated by air blown out from the partition.

The partition (1) of this example blows air toward a first plane (R1) facing the blow-out ports (14). The first plane (R1) is a virtual plane (R) of the present disclosure. The blower fan (20) is controlled so as to generate, on the first plane (R1), an airflow whose average momentum p per unit area irregularly changes in a range of 0.05 kg/ms$^2$ or more and 0.75 kg/ms$^2$ or less. The first plane (R1) is a region where a wind velocity is 0.2 m/s or more. Referring to FIG. 7, the first plane (R1) is a plane formed perpendicular to and centered on a center line CL (line extending forward from the center O of the blow-out port (14)). Specifically, the first plane (R1) is a rectangular plane having a width of 0.6 m and a height of 0.5 m about a point O1 on the center line CL at a position apart by 0.3 m from the center O.

The average momentum p of airflow generated by air blown out through the blow-out port (14) of the partition (1) is obtained by Average Momentum p [kg/ms$^2$]=Air Density ρ [kg/m$^3$]×Area A [m$^2$]×Flow Velocity v [m/s]×Flow Velocity v [m/s]/Area A [m$^2$]. The average momentum is a vector quantity having a direction. The blower fan (20) is controlled so as to generate, on the first plane (R1), an airflow whose average momentum p per unit area irregularly changes in a range of 0.05 kg/ms$^2$ or more and 0.75 kg/ms$^2$ or less when the environment of the indoor space (S) has a room temperature of 20° C. and 1 atm (standard atmospheric pressure). The air density p at a temperature of 20° C. and a pressure of 1 atm is 0.166 kg/m$^3$. The airflow whose average momentum p is in the range of 0.05 kg/ms$^2$ or more and 0.75 kg/ms$^2$ or less is in a range of 0.2 [m/s] or more and 0.8 [m/s] or less in terms of wind velocity.

Air Flow in Casing

Figure 8A:
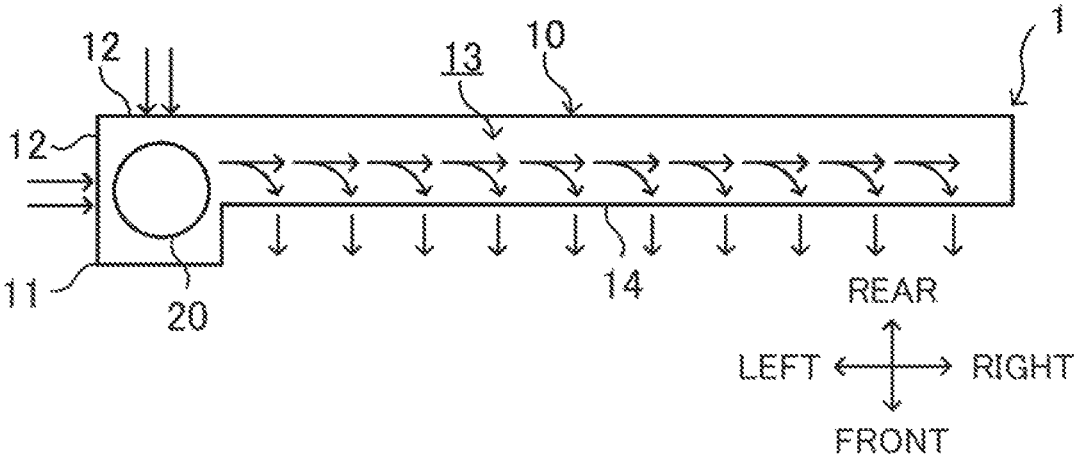
FIG. 8A and FIG. 8B are views schematically illustrating air flows inside and outside the partition.
Figure 8B:
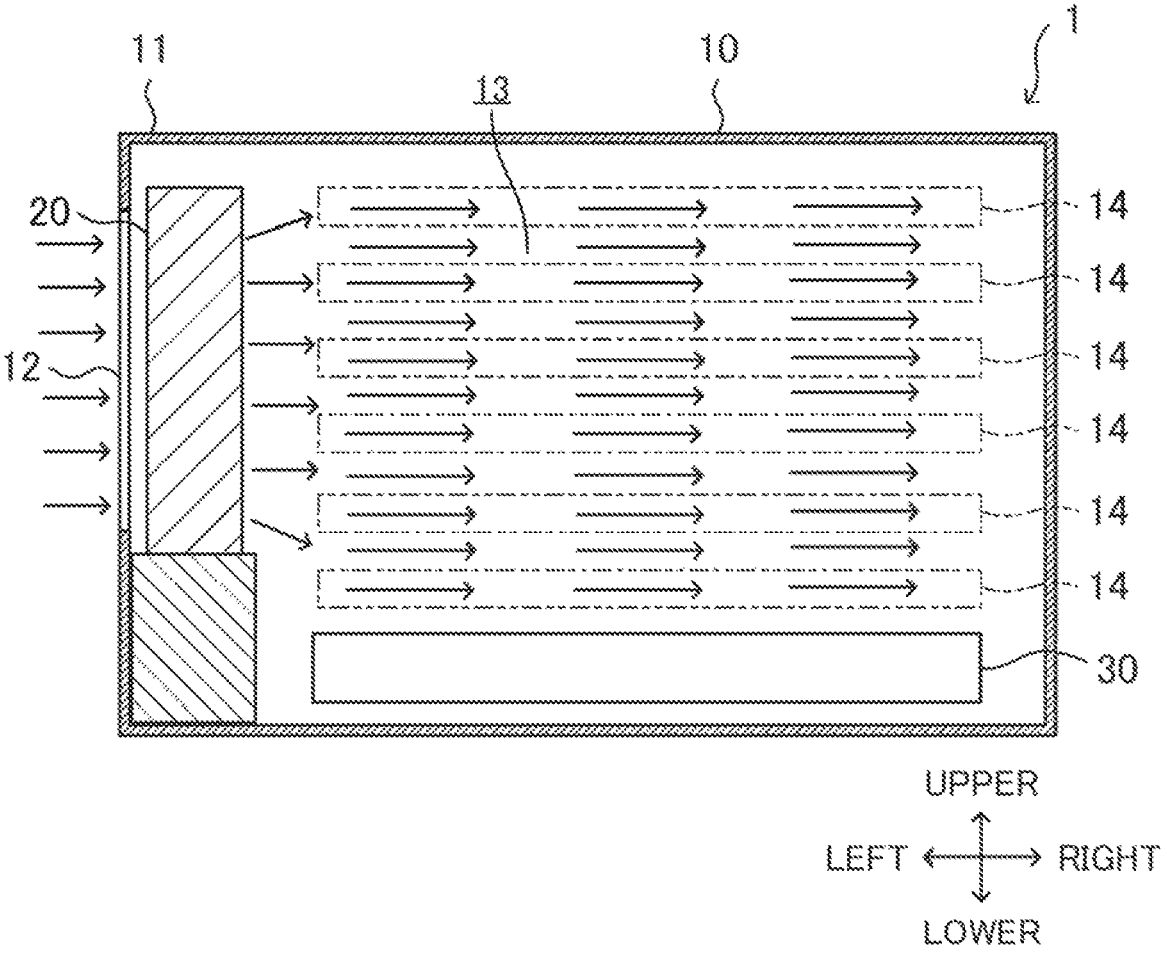

Next, an air flow in the casing (10) will be described with reference to FIG. 8A and FIG. 8B. FIG. 8A illustrates the cross section of the partition (1) as viewed from above. FIG. 8B illustrates the longitudinal section of the partition (1) as viewed from the front. Arrows in FIG. 8A and FIG. 8B indicate a direction in which air flows.

When the blower fan (20) is turned on, air is sucked through the suction ports (12). The sucked air is delivered from the blower fan (20) to the air passage (13). The air in the air passage (13) is blown out through the blow-out ports (14) while flowing toward the tip end (right surface) of the air passage (13). In this manner, the air is blown out through all the openings of the blow-out ports.

Problems when Partition is Arranged

In a small space partitioned by partitions arranged in a room, these partitions interfere with the flow of air supplied from, e.g., an air conditioner, and as a result, it is difficult to ventilate the small space. For this reason, in such a small space partitioned by the partitions, air stagnates such that the risk of infection by, e.g., pathogenic bacteria might increase. Although air stagnation in the small space can be eliminated by opening a window or a door, outside air is directly introduced therein. For this reason, a room temperature changes, the air-conditioning load of the indoor space increases, and power consumption increases. If a circulator is installed in the indoor space, air stagnation in the small space can be reduced without opening the window or the door. However, when the wind velocity of the circulator is increased to eliminate air stagnation in the small space, the power consumption and noise increase. In addition, when the wind velocity increases, a person near the circulator feels uncomfortable. On the other hand, although the power consumption and the uncomfortable feeling can be reduced by decreasing the wind velocity of the circulator, the decrease in the wind velocity tends to cause air stagnation in the small space.

To deal with these problems, the partition (1) of this embodiment has a blowing function of blowing air into a predetermined space. The partition (1) generates, on the virtual plane (R) facing the blow-out ports (14) and having a wind velocity of 0.2 m/s or more, an airflow whose average momentum per unit area is 0.05 kg/ms$^2$ or more and 0.75 kg/ms$^2$ or less.

By sending air to the small space (ss) partitioned by the partitions (1) of this embodiment, air stagnation in the small space (ss) can be eliminated, and uniform ventilation can be achieved. As described above, the partition (1) of this embodiment can improve the efficiency of ventilation of the small space (ss). Consequently, the efficiency of ventilation of the entire indoor space (S) can also be improved.

In addition, on the virtual plane (R) on which an airflow having a wind velocity of 0.2 m/s or more where a person feels wind is generated, the average momentum of the airflow per unit area is set to 0.05 kg/ms$^2$ or more and 0.75 kg/ms$^2$ or less, whereby the flow velocity of air blown out through the blow-out port (14) can be reduced. Thus, the power consumption and the noise can be reduced.

In addition, by irregularly changing the average momentum of the airflow in the range of 0.05 kg/ms$^2$ or more and 0.75 kg/ms$^2$ or less, it is possible to eliminate air stagnation without impairing the comfort of a person.

In addition, by setting the lower limit of the average momentum of the blown air to 0.05 kg/ms$^2$, a person can feel wind even if there is disturbance or natural convection. Further, by setting the upper limit of the average momentum of the blown air to 0.75 kg/ms$^2$, a person can feel comfortable.

In addition, since the partition (1) is portable, the small space (ss) having a desired size can be formed at a desired position. Further, installation work such as construction work is not necessary.

In the partition (1) of this embodiment, the momentum of air blown out through the blow-out port (14) is irregularly changed on the virtual plane (R). When the momentum of air changes irregularly, fluctuating wind is generated. The comfort of a person in the space partitioned by the partitions (1) can be improved by the fluctuating wind.

In the partition (1) of this embodiment, the first plane (R1) (virtual plane (R)) is a plane having a width of 0.6 m and a height of 0.5 m at the position 0.3 m away from the blow-out port (14). With this configuration, for example, even if the small space (ss) has a space enough for only one person, the efficiency of ventilation of the small space (ss) can be improved while the comfort is maintained. Consequently, the efficiency of ventilation of the indoor space (S) can also be improved.

The partition (1) of this embodiment further includes the rectifying members (40) that makes a uniform flow direction of air blown out through the blow-out port (14). With the rectifying members (40), the air blown out through the blow-out port (14) can flow in the same direction regardless of a blow-out position. In addition, the volume of air blown out through the blow-out port (14) is also made uniform regardless of the blow-out position. Since the vector of the momentum of the blown air is unified in this manner, the small space (ss) can be efficiently ventilated even with a small momentum. Further, it is possible to reduce variation in the volume of air and to reduce impairment of the comfort in the small space (ss).

The partition (1) of this embodiment further includes the air passage (13) provided in the casing (10). The air passage (13) extends in the first direction in which air is delivered from the blower mechanism (20), and is formed such that the tip end of the air passage (13) is closed. The blow-out ports (14) are arranged along the air passage (13). The rectifying member (40) is provided in the blow-out port (14), and has the porous portion (41) formed with the plurality of holes. The porous portion (41) is formed such that the opening area of the hole gradually decreases from the intermediate position toward both ends of the air passage (13) in the first direction thereof.

By forming the blow-out ports (14) over the substantially entire front surface of the casing (10), the area of the blow-out ports (14) can be increased. By increasing the opening area of the blow-out ports (14), the momentum p of the airflow blown out through the blow-out ports (14) can be sufficiently ensured even if the flow velocity of the airflow from the blow-out ports (14) is reduced. With this configuration, the comfort in the small space (ss) and the efficiency of ventilation of the small space (ss) can be improved.

In addition, since the tip end of the air passage (13) is closed and the porous portion (41) is formed such that the opening area of the hole (41*a*) gradually decreases from the intermediate position toward both ends in the first direction, the direction and volume of air blown out through the blow-out port (14) can be made uniform.

The partition (1) of this embodiment further includes the heater (heat supply device) (30) that supplies heat to a position close to the lower end of the casing (10). With this configuration, in the winter, the feet of a person in the small space (ss) can be warmed and environment where the head is cold and the feet are warm can be formed in the small space (ss). This improves the comfort.

First Variation

Figure 9:
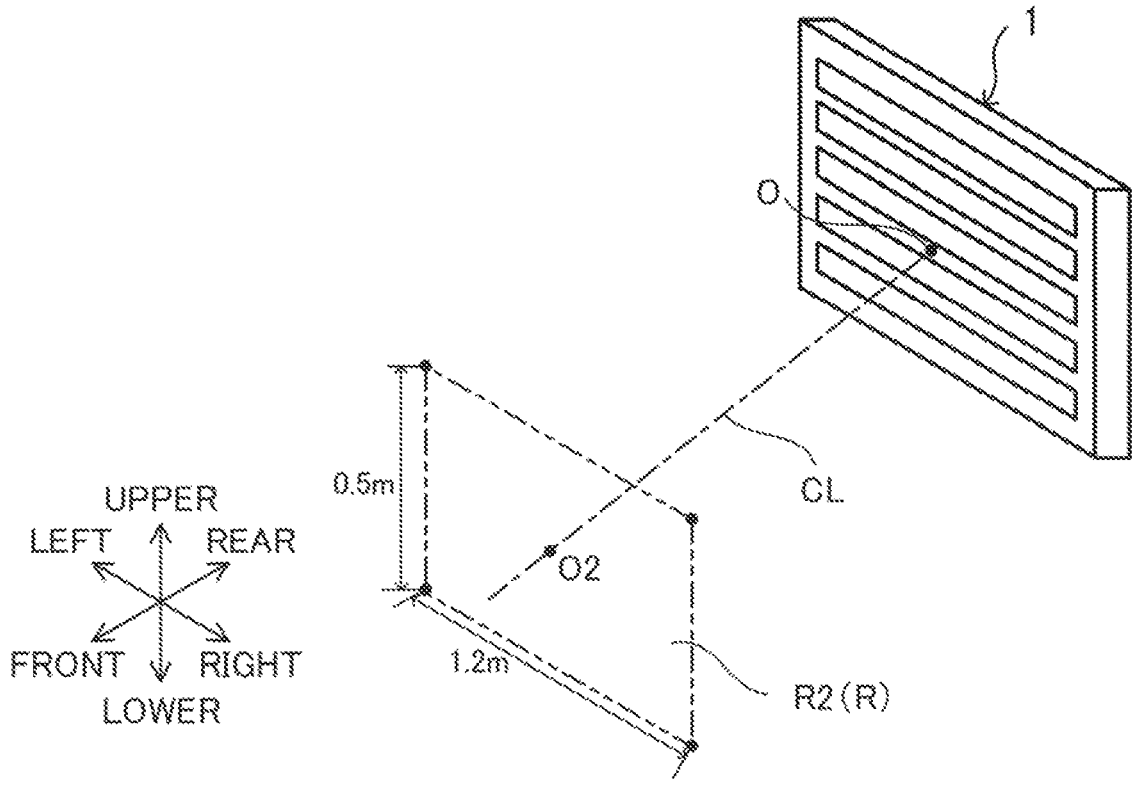
FIG. 9 is a view corresponding to FIG. 7 for describing a virtual plane on which an airflow is generated by air blown out from a partition of a first variation.

The opening area of the blow-out ports (14) of the partition (1) of this example is greater than that of the partition (1) of the above-described embodiment. The partition (1) of this example sends air toward a second plane (R2) facing the blow-out ports (14). The second plane (R2) is a virtual plane (R) of the present disclosure. The blower fan (20) is controlled so as to generate, on the second plane (R2), an airflow whose average momentum p per unit area irregularly changes in a range of 0.05 kg/ms$^2$ or more and 0.75 kg/ms$^2$ or less. The second plane (R2) is a region where a wind velocity is 0.2 m/s or more. Referring to FIG. 9, the second plane (R2) is a plane formed perpendicular to and centered on the center line CL. Specifically, the second plane (R2) is a rectangular plane having a width of 1.2 m and a height of 0.5 m about a point O2 on the center line CL at a position apart by 2.0 m from the center O.

As described above, in this partition (1), at a position farther from the blow-out port (14) than that for the first plane (R1), an airflow whose average momentum p irregularly changes in a range of 0.05 kg/ms$^2$ or more and 0.75 kg/ms$^2$ or less can be generated on the second plane (R2) having the area greater than that of the first plane (R1). With this configuration, for example, even if the small space (ss) is a space enough for three to four persons, the efficiency of ventilation of the small space (ss) can be improved while the comfort is maintained. Consequently, the efficiency of ventilation of the indoor space (S) can also be improved.

Second Variation

Figure 10:
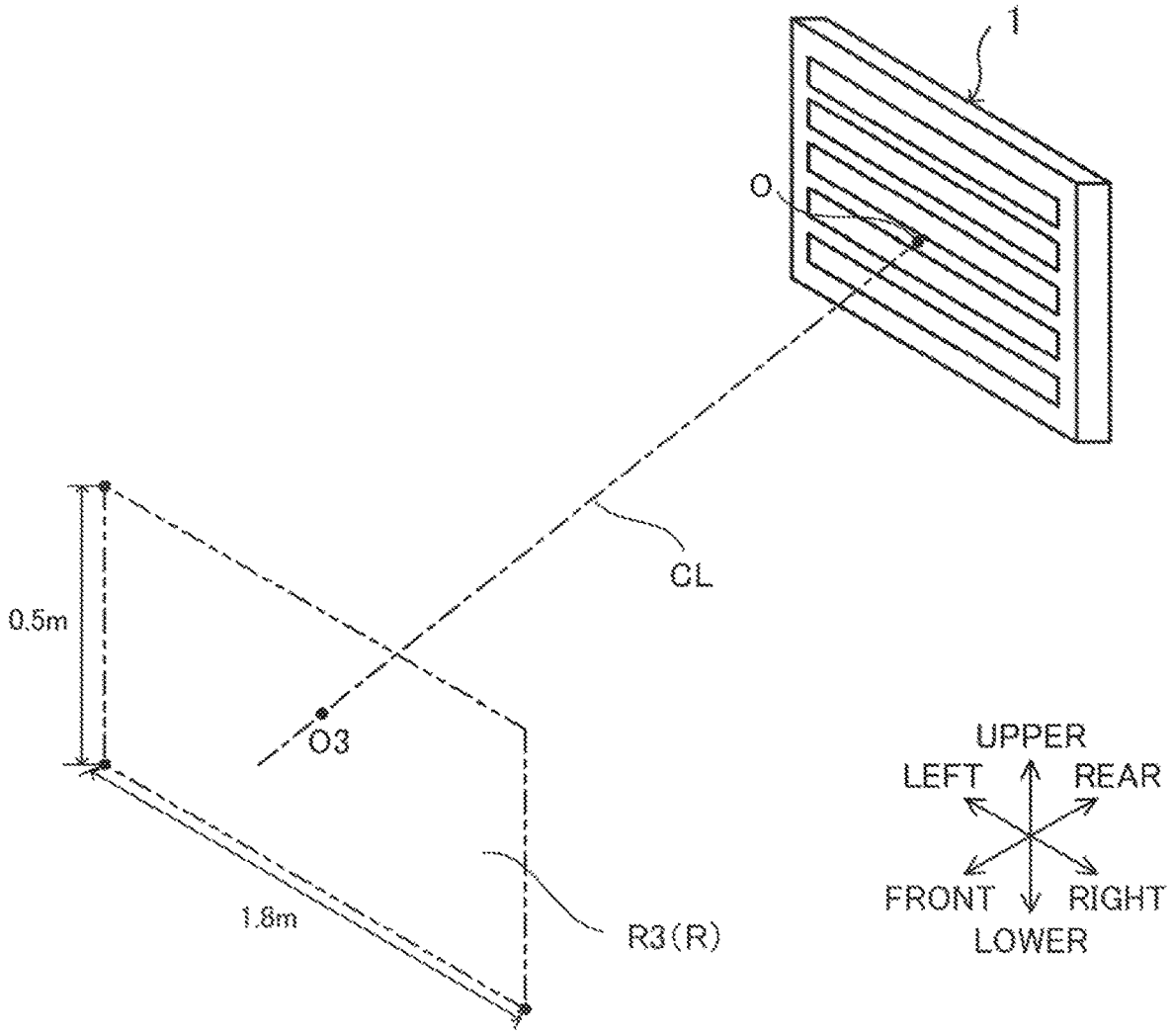
FIG. 10 is a view corresponding to FIG. 7 for describing a virtual plane on which an airflow is generated by air blown out from a partition of a second variation.

The opening area of the blow-out ports (14) of the partition (1) of this example is greater than that of the partition (1) of the above-described first variation. The partition (1) of this example sends air toward a third plane (R3) facing the blow-out ports (14). The third plane (R3) is a virtual plane (R) of the present disclosure. The blower fan (20) is controlled so as to generate, on the third plane (R3), an airflow whose average momentum p per unit area irregularly changes in a range of 0.05 kg/ms$^2$ or more and 0.75 kg/ms$^2$ or less. The third plane (R3) is a region where a wind velocity is 0.2 m/s or more. Referring to FIG. 10, the third plane (R3) is a plane formed perpendicular to and centered on the center line CL. Specifically, the third plane (R3) is a rectangular plane having a width of 1.8 m and a height of 0.5 m about a point O3 on the center line CL at a position apart by 4.0 m from the center O.

As described above, in this partition (1), at a position farther from the blow-out port (14) than that for the second plane (R2), an airflow whose average momentum p irregularly changes in a range of 0.05 kg/ms$^2$ or more and 0.75 kg/ms$^2$ or less can be generated on the third plane (R3) having the area greater than that of the second plane (R2). With this configuration, for example, even if the small space (ss) is a space enough for four or more persons, the efficiency of ventilation of the small space (ss) can be improved while the comfort is maintained. Consequently, the efficiency of ventilation of the indoor space (S) can also be improved.

By using the partitions (1) of the embodiment, the first variation, and the second variation as described above according to the size of the small space (ss), it is possible to form the small space (ss) having a relatively high ventilation efficiency while maintaining the comfort.

Third Variation

Regarding a partition (1) of a third variation, a configuration different from that of the partition (1) of the above-described embodiment will be described.

Figure 11:
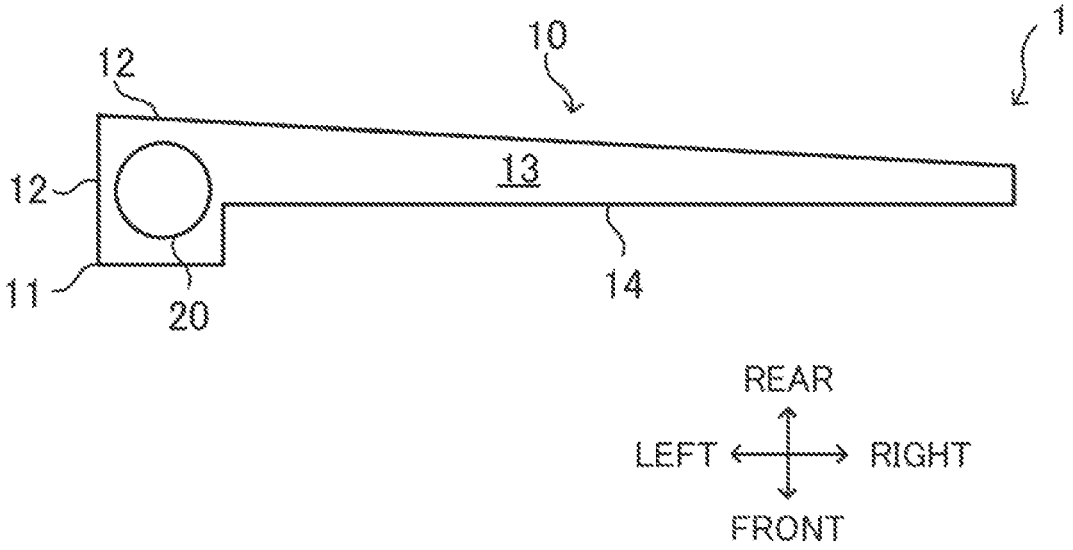
FIG. 11 is a view of a partition of a third variation and corresponds to FIG. 3.

As illustrated in FIG. 11, the casing (10) is formed such that the front surface and the rear surface become closer to each other as approaching the right end. With this configuration, the air passage (13) is formed such that a flow path sectional area which is a section perpendicular to the right direction (first direction) gradually decreases in the right direction. The partition (1) of this example has no rectifying member (40).

As described above, the flow path sectional area of the air passage (13) gradually decreases in the direction in which air flows from the blower fan (20), so that the flow direction and volume of air blown out through all the blow-out ports (14) can be made uniform. With this configuration, it is possible to reduce variation in wind velocity in the small space (ss). As a result, it is possible to increase the ventilation efficiency without impairing the comfort of a person in the small space (ss).

Fourth Variation

Regarding a partition (1) of a fourth variation, a configuration different from that of the partition (1) of the above-described embodiment will be described.

Figure 12:
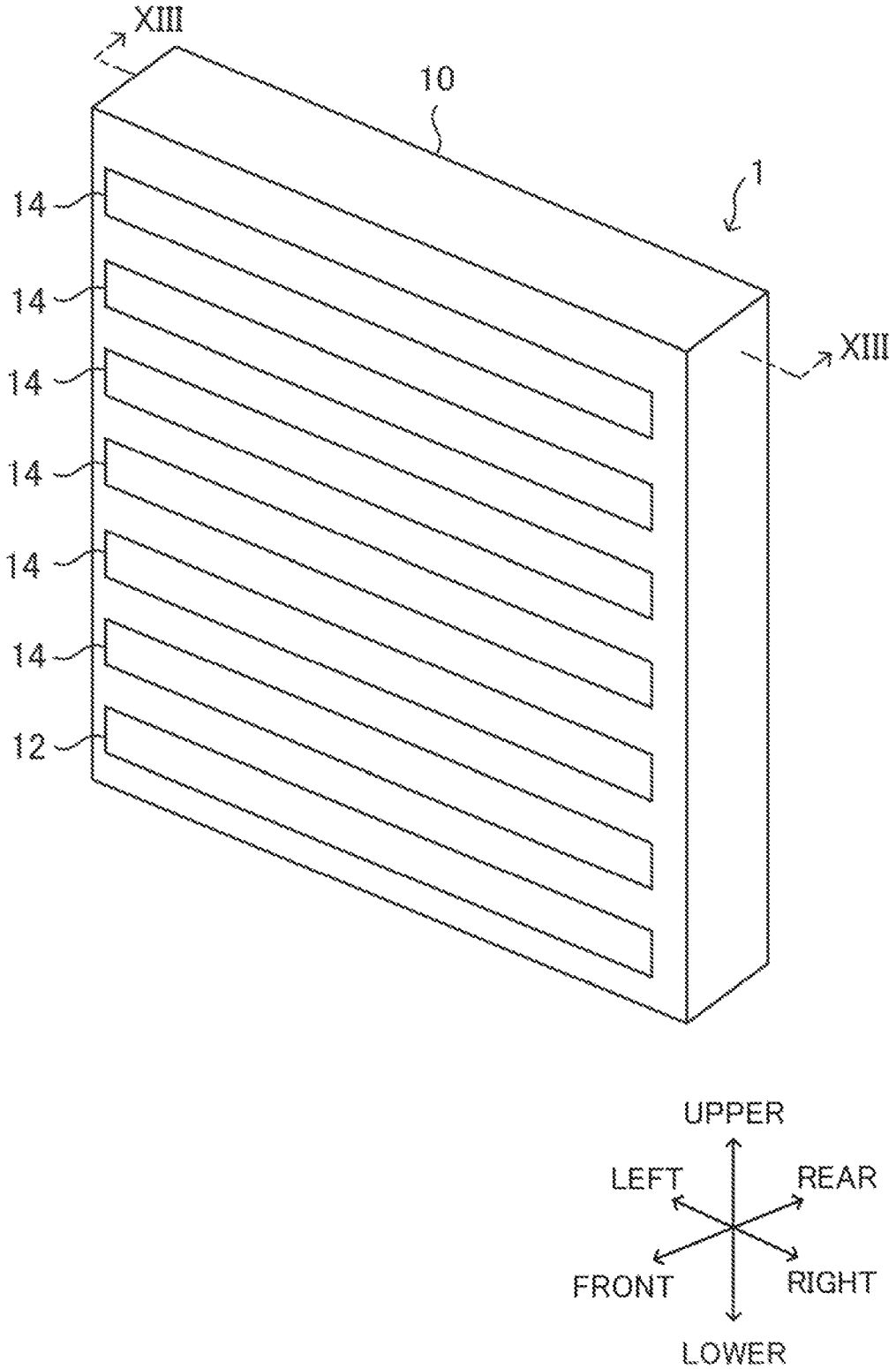
FIG. 12 is a view of a partition of a fourth variation and corresponds to FIG. 2.
Figure 13:
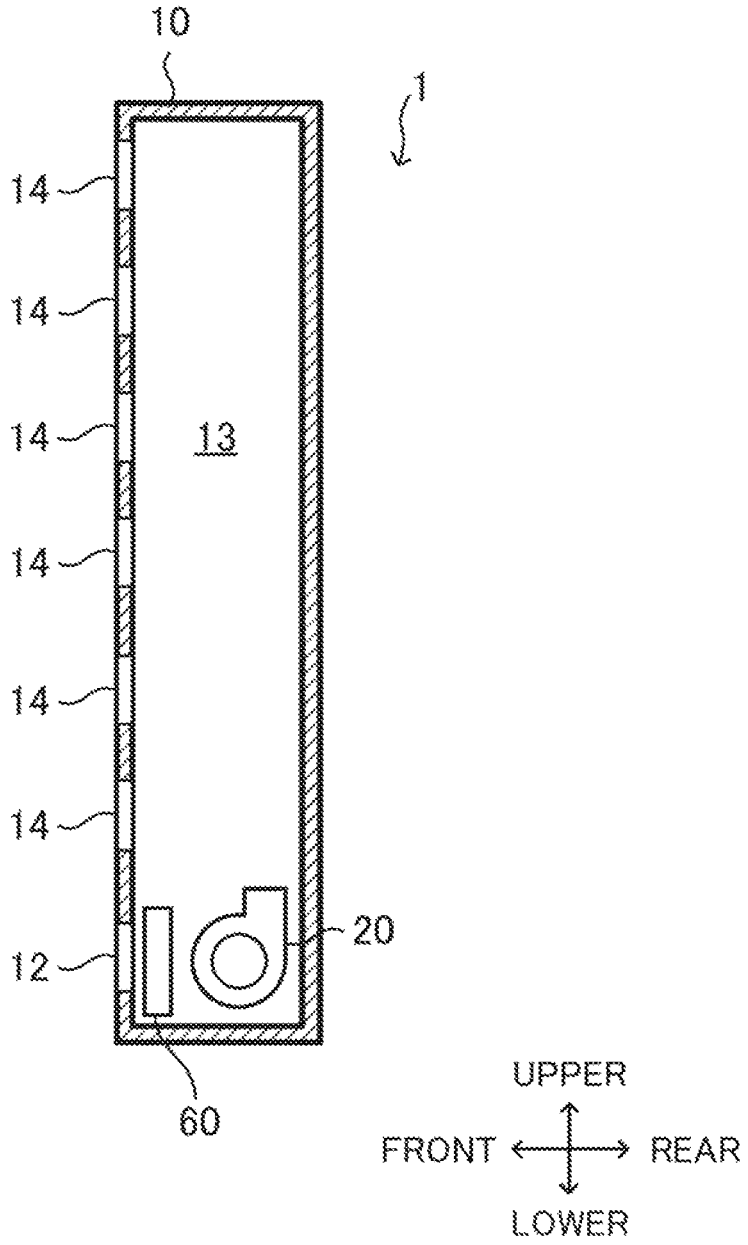
FIG. 13 is a view illustrating the section of the partition of FIG. 12 taken along line XIII-XIII

As illustrated in FIGS. 12 and 13, the suction port (12) of the partition (1) of this example is formed in a lower portion of the front surface of the casing (10). Specifically, the suction port 12 may be formed in the rear surface of the casing 10. The suction port (12) is formed so as to extend in the right-left direction of the casing (10).

The blower fan (20) of the partition (1) of this example is arranged in the lower end of the casing (10). The blower fan (20) of this example is, for example, a sirocco fan or a turbo fan. Air is delivered upward in the casing (10) by the blower fan (20). In this example, the upward direction is a first direction of the present disclosure. In this example, the air passage (13) is formed in the upper-lower direction. In this manner, the blower fan (20) delivers air sucked through the suction port (12) upward in the air passage (13).

The partition (1) of this example includes an air purification filter (60). The air purification filter (60) is an air purification unit (60) of the present disclosure. The air purification filter (60) is arranged at the suction port (12).

Also in this example, since the blow-out ports (14) are formed over the substantially entire front surface of the casing (10), the airflow whose average momentum p per unit area of the virtual plane (R) irregularly changes in the range of 0.05 $kg/ms^2$ or more and 0.75 $kg/ms^2$ or less is generated, so that the comfort in the small space (ss) can be improved and the small space (ss) can be efficiently ventilated. With the air purification filter (60), the small space (ss) can be supplied with air from which a floating substance such as pollen, house dust, dust, or a microorganism has been removed. As a result, it is possible to suppress an increase in the risk of infection by, e.g., pathogenic bacteria, to alleviate allergic symptoms, and therefore to provide a sense of security to a person in the small space (ss).

Fifth Variation

Regarding a partition (1) of a fifth variation, a configuration different from that of the partition (1) of the above-described embodiment will be described.

Figure 14:
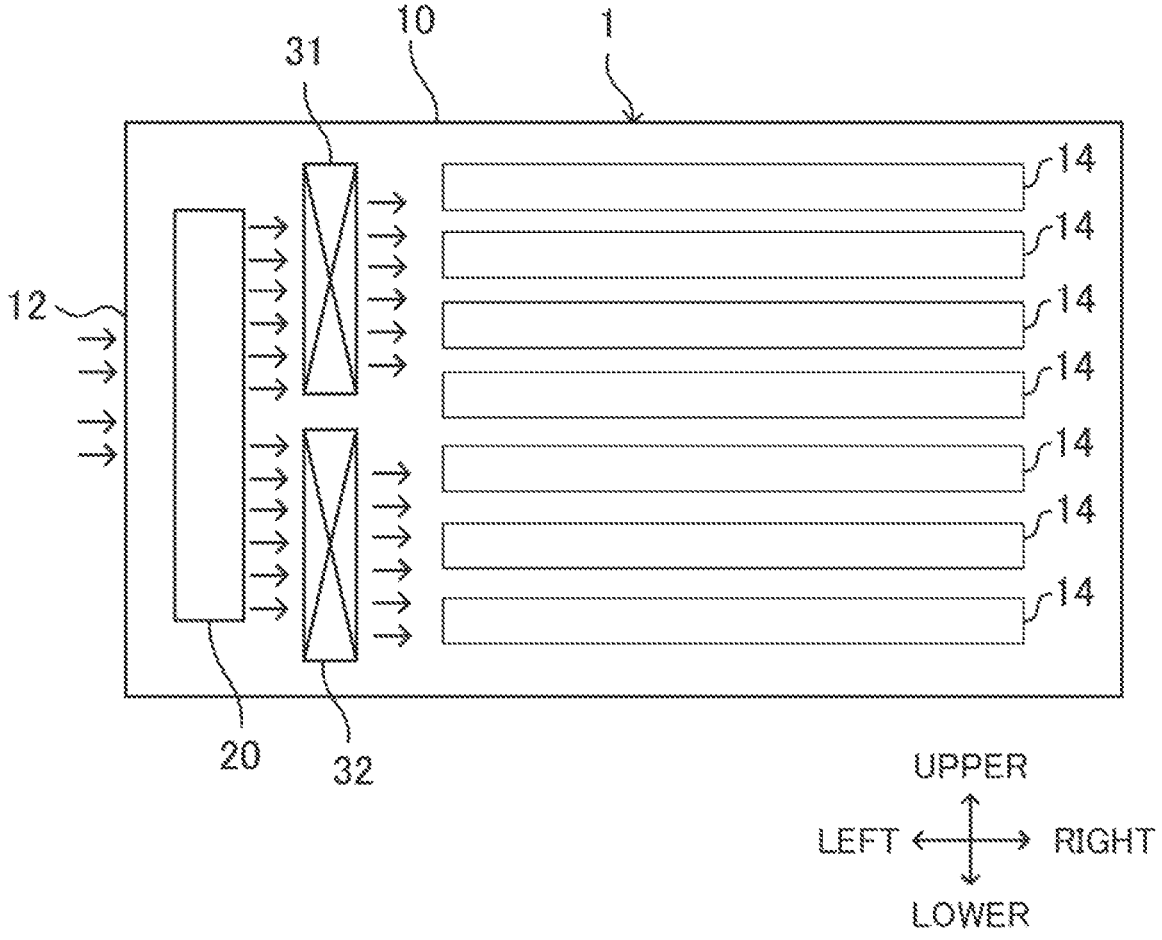
FIG. 14 is a view of the configuration of a partition of a fifth variation from the front.

As illustrated in FIG. 14, the heater (30) of the fifth variation is of a heat pump type. Specifically, the heater (30) has an evaporator (31) and a radiator (32). The evaporator (31) and the radiator (32) are connected to a refrigerant circuit including a decompression valve (not shown) and a compressor (not shown). When the refrigerant circuit performs a refrigeration cycle, refrigerant dissipates heat to air in the radiator and absorbs heat from air by evaporating in the evaporator. Arrows illustrated in FIG. 14 indicate the flow of air.

The evaporator (31) and the radiator (32) are arranged between the blower fan (20) and the inflow end of the air passage (13). The evaporator (31) is arranged above the radiator (32). Of air blown out from the blower fan (20), air flowing through an upper portion in the casing (10) is cooled by passing through the evaporator (31) and exchanging heat with refrigerant. The cooled air flows through an upper portion of the air passage (13), and is blown out through the blow-out ports (14) arranged in the upper portion of the casing (10). Of the air blown out from the blower fan (20), air flowing through a lower portion in the casing (10) is heated, on the other hand, by passing through the radiator (32) and exchanging heat with refrigerant. The heated air flows through a lower portion of the air passage (13), and is blown out through the blow-out ports (14) arranged in the lower portion of the casing (10).

As described above, the partition (1) of this example can blow out relatively cool air to an upper portion of the small space (ss) and blow relatively warm air to a lower portion of the small space (ss). This improves the comfort in the small space (ss).

Sixth Variation

Regarding a partition (1) of a sixth variation, a configuration different from that of the partition (1) of the above-described embodiment will be described.

Figure 15:
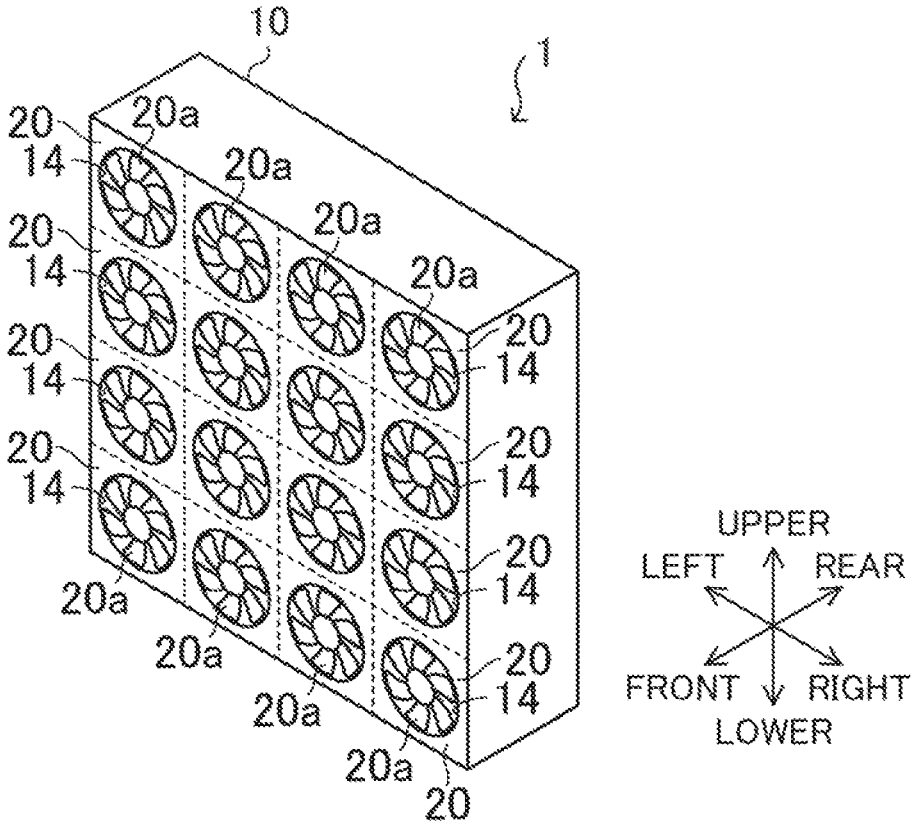
FIG. 15 is a three-dimensional perspective view illustrating the configuration of a partition of a sixth variation.

As illustrated in FIG. 15, the partition (1) of this example includes an axial flow fan as the blower fan (20). The axial flow fan includes an impeller (20*a*). The impeller (20*a*) is a so-called propeller fan. Although not shown, each blower fan (20) is provided with a fan motor that drives the impeller (20*a*). The impeller (20*a*) is attached to an output shaft of the fan motor.

In the partition (1) of this example, sixteen blower fans (20) are arranged in a matrix, which includes four in the right-left direction and four in the upper-lower direction, in the casing (10). In the casing (10), the sixteen blower fans (20) face the front surface of the casing (10). In the front surface of the casing (10), the blow-out ports (14) are formed at positions corresponding to the sixteen blower fans (20). Similarly to the blower fans (20), the blow-out ports (14) are arranged in a matrix which includes four in the right-left direction and four in the upper-lower direction. Although not shown, the suction port is formed in the rear surface of the casing (10).

Seventh Variation

Regarding a partition (1) of a seventh variation, a configuration different from that of the partition (1) of the above-described embodiment will be described.

Figure 16:
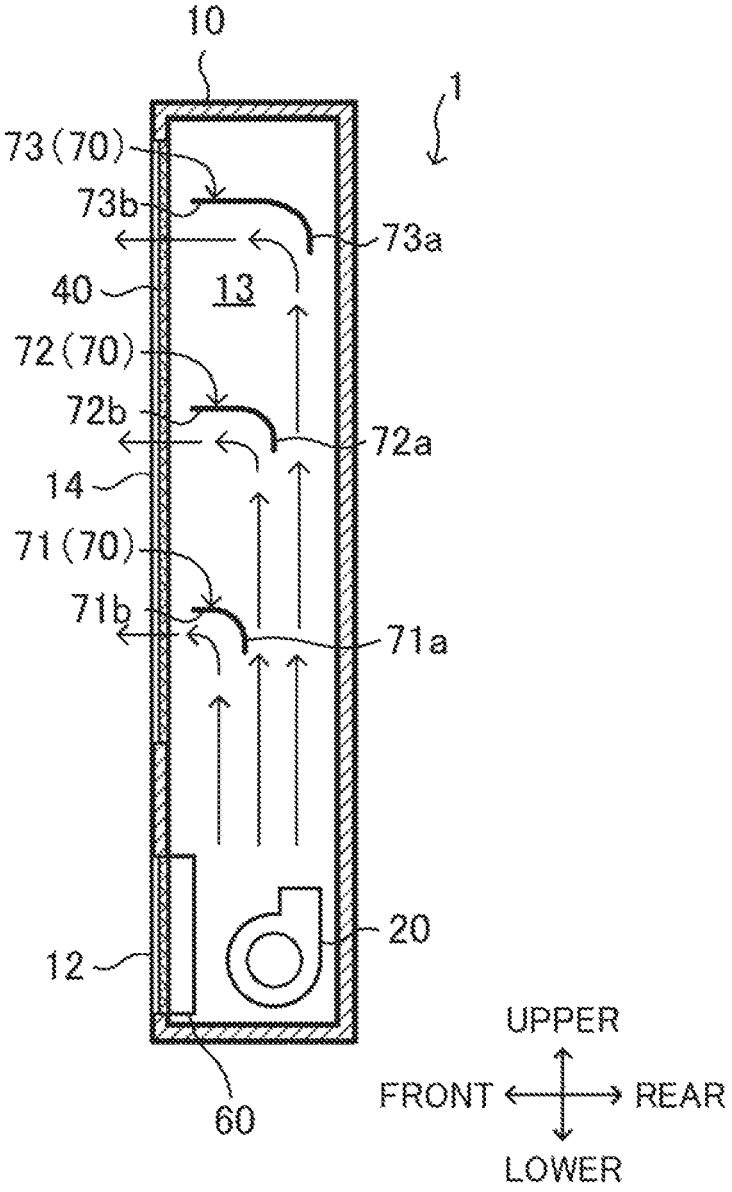
FIG. 16 is a view of a partition of a seventh variation and corresponds to FIG. 13.

FIG. 16 is a longitudinal sectional view of the partition (1) according to the seventh variation. As illustrated in FIG. 16, the suction port (12) of the partition (1) of this example is formed in a lower portion of the front surface of the casing (10).

The suction port (12) is formed so as to extend in the right-left direction of the casing (10). The opening area of the suction port (12) of this example is formed to be greater than the sectional area of the air passage (13) perpendicular to the air flow direction. The air passage (13) is formed in the upper-lower direction. In this example, the upward direction is a first direction of the present disclosure. The upper end of the air passage (13) is closed by a top panel of the casing.

The blower fan (20) of the partition (1) of this example is arranged in the lower end of the casing (10). The blower fan (20) of this example is a sirocco fan. Air is delivered upward in the casing (10) by the blower fan (20). In this example, the blower fan (20) delivers air sucked through the suction port (12) upward in the air passage (13).

Also in this example, the suction port (14) is arranged along the air passage (13). The blow-out port (14) is formed above the suction port (12) in the front surface, where the suction port (12) is formed, of the casing (10). The opening area of the blow-out port (14) is greater than the opening area of the suction port (12). The blow-out port (14) is formed over the substantially entire front surface of the casing (10) except for the suction port (12). The blow-out port (14) is provided with the rectifying member (40). The rectifying member (40) is formed in a honeycomb shape in which octagonal holes are regularly arranged.

The air passage (13) is provided with a guide portion (70). The guide portion (70) guides air in the air passage (13) to the blow-out port (14) so as to make a uniform wind velocity of air blown out through the blow-out port (14). Specifically, the guide portion (70) has a first flap (71), a second flap (72), and a third flap (73). In the air passage (13), the first flap (71), the second flap (72) and the third flap (73) are arranged in order from below. The first flap (71) is arranged at a position higher than the lower end of the blow-out port (14). The third flap (73) is arranged at a height position lower than the upper end of the blow-out port (14). The first flap (71), the second flap (72), and the third flap (73) are arranged at equal intervals in the upper-lower direction.

Each flap (71, 72, 73) extends in the right-left direction of the air passage (13). Specifically, each flap (71, 72, 73) extends from one end to the other end of the air passage (13) in the right-left direction.

Each flap (71, 72, 73) is formed in an inverted L-shape in longitudinal section. Specifically, each flap (71, 72, 73) includes a first plate member (71*a*, 72*a*, 73*a*) facing the front surface (back surface) of the casing (10) and a second plate member (71*b*, 72*b*, 73*b*) connected to the upper end of the first plate member (71*a*, 72*a*, 73*a*). The second plate member (71*b*, 72*b*, 73*b*) is arranged so as to face the upper surface of the casing (10). The first plate member (71*a*, 72*a*, 73*a*) and the second plate member (71*b*, 72*b*, 73*b*) are connected to each other such that the longitudinal section thereof is curved in an arc shape.

In each flap (71, 72, 73), the second plate members (71*b*, 72*b*, 73*b*) have different lengths in the front-rear direction. Specifically, the second plate member (71*b*) of the first flap (71), the second plate member (72*b*) of the second flap (72), and the second plate member (73*b*) of the third flap (73) are formed such that the length thereof in the front-rear direction increases in this order.

Each flap (71, 72, 73) is arranged such that the front end of the second plate member (71*b*, 72*b*, 73*b*) is at the same distance from the blow-out port (14). With this configuration, the first plate members (71*a*, 72*a*, 73*a*) are at different positions in the front-rear direction. Specifically, the first plate member (71*a*) of the first flap (71) is arranged on the front side with respect to the first plate member (72*a*) of the second flap (72), and the first plate member (72*a*) of the second flap (72) is arranged on the front side with respect to the first plate member (73*a*) of the third flap (73).

The suction port (12) is provided with the air purification filter (60). The air purification filter (60) is provided over the entire region of the suction port (12).

An air flow in the partition (1) of this example will be described. Arrows shown in the partition (1) in FIG. 16 indicate the direction of air flow.

Of air delivered from below by the blower fan (20), air passing on the front side of the first plate member (71*a*) of the first flap (71) is guided by the second plate member (71*b*) of the first flap (71), and is blown out from the height position of the first flap (71) (specifically, between the lower end of the blow-out port (14) and the height position of the first flap (71)).

Of air passing on the back side of the first plate member (71*a*) of the first flap (71), air passing on the front side of the first plate member (72*a*) of the second flap (72) is guided by the second plate member (72*b*) of the second flap (72), and is blown out from the height position of the second flap (72) (specifically, between the height position of the first flap (71) and the height position of the second flap (72)).

Air having passed on the back side of the first plate member (72*a*) of the second flap (72) passes on the front side of the first plate member (73*a*) of the third flap (73), is guided by the second plate member (73*b*) of the third flap (73), and is blown out from the height position of the third flap (73) (specifically, between the height position of the second flap (72) and the height position of the third flap (73)).

As described above, air flowing through the air passage (13) is divided into a plurality of flows by the guide portion (70), and then, is blown out from the entire area of the blow-out port (14) such that the air flow rate is uniform. With this configuration, the wind velocity of the air blown out through the blow-out port (14) is made uniform. Further, since the blow-out port (14) is provided with the rectifying member (40), the air is rectified and blown out through the blow-out port (14).

In addition, the suction port (12) is provided with the air purification filter (60) to purify air flowing into the suction port (12). Since the opening area of the suction port (12) is greater than the sectional area of the air passage (13) perpendicular to the air flow, the air flow resistance of the air flowing through the air passage (13) can be reduced as compared to a case where the air passage (13) is provided with the air purification filter (60). With this configuration, the operating load of the blower fan (20) can be reduced, energy saving and cost saving can be achieved, and the life of the blower fan (20) can be extended.

Also in this example, since the blow-out port (14) is formed over the substantially entire front surface of the casing (10), the airflow whose average momentum p per unit area of the virtual plane (R) is in the range of 0.05 $kg/ms^2$ or more and 0.75 $kg/ms^2$ or less is generated, so that the comfort in the small space (ss) can be improved and the small space (ss) can be efficiently ventilated.

OTHER EMBODIMENTS

The embodiment and variations described above may also be configured as follows.

The airflow generated by the blower fan (20) may have a momentum per unit area in a range of 0.05 $kgm/s^2$ or more and 0.75 $kgm/s^2$ or less.

The blower fan (20) is only required to generate the airflow whose average momentum per unit area is in the range of 0.05 kg/ms$^2$ or more and 0.75 kg/ms$^2$ or less, and the average momentum does not necessarily change.

The blower fan (20) may generate an airflow whose average momentum per unit area regularly changes in an average range of 0.05 kg/ms$^2$ or more and 0.75 kg/ms$^2$ or less.

The partition (1) of the above-described embodiment is not necessarily provided with the heater (30). In other variations, the partition (1) may be provided with the heater (30).

A plurality of partitions (1) may be combined according to the size of the small space (ss). In the combination, for example, a plurality of partitions (1) may be arranged vertically or horizontally adjacent to each other, or a pair of partitions (1) may be arranged so as to face each other such that the blow-out ports (14) face each other.

The blower fans (20) of the embodiment and the second variation described above may be sirocco fans, turbo fans, or propeller fans.

The partition (1) of the first variation described above may have the rectifying member (40).

The blower fan (20) of the second variation described above may be a cross-flow fan or a propeller fan.

The partitions (1) of the embodiment described above and the variations other than the second variation described above may have the air purification units (60). The air purification unit (60) is arranged at the suction port (12).

The air purification unit (60) may have a function of deodorizing or sterilizing sucked air in addition to a function of removing a floating substance etc. contained in the sucked air. For example, the air purification unit (60) may have a UV sterilization lamp, a deodorizing filter, a streamer unit, etc.

In the embodiment, the porous portion (41) of the rectifying member (40) is only required to be formed such that the air flow resistance of the hole (41*a*) in the vicinity of the middle in the right-left direction is smaller than the air flow resistance of the hole (41*a*) in the vicinity of each end.

The rectifying member (40) may be cloth. In this case, air is blown out through the weave pattern of the cloth, and therefore, the direction and volume of blown air can be made uniform regardless of the position in the blow-out port (14). The rectifying member (40) may be a louver. The direction and volume of blown air can be adjusted by the louver.

In the sixth variation described above, the partition (1) does not necessarily have the sixteen blower fans (20), and may be configured such that sixteen or less blower fans (20) or sixteen or more blower fans (20) are arranged in a matrix. Further, the number of blower fans (20) in the right-left direction and the number of blower fans (20) in the upper-lower direction may not necessarily be the same as each other.

In the fourth or seventh variation described above, the air purification filter (60) may be provided in the blow-out port (14). With this configuration, air passing through the air purification filter (60) is rectified. As described above, the air purification filter (60) serves both to purify air in the air passage (13) and to rectify blown air, thereby eliminating the need for providing the rectifying member (40) in the blow-out port (14).

While the embodiment and variations thereof have been described above, it will be understood that various changes in form and details may be made without departing from the spirit and scope of the claims. The foregoing embodiments and variations thereof may be combined and replaced with each other without deteriorating the intended functions of the present disclosure. The expressions of "first," "second," . . . described above are used to distinguish the terms to which these expressions are given, and do not limit the number and order of the terms.

As described above, the present disclosure is useful for a partition.

The invention claimed is:

1. A partition having an air blowing function of blowing air to a predetermined region, the partition comprising:
- a casing;
- a blower mechanism arranged in the casing;
- an electronic controller configured to control the blower mechanism;
- a blow-out port located on a side of the casing:
- an air passage provided in the casing, the air passage extending in a first direction in which air is delivered from the blower mechanism, and
  - being formed such that a downstream end of an airflow in the air passage is closed,
- the blow-out port being arranged along the air passage,
- on a virtual plane facing the blow-out port and having a wind velocity between 0.55 m/s and 2.125 m/s, inclusive, an airflow with an average momentum per unit area from 0.05 kg/ms$^2$ to 0.75 kg/ms$^2$ being generated, the virtual plane being a vertical plane, and
- the controller being configured to control the blower mechanism such that a momentum of air blown out through the blow-out port irregularly changes on the virtual plane.

2. The partition of claim 1, wherein
- the virtual plane is a plane having a width of 0.6 m and a height of 0.5 m at a position spaced 0.3 m from the blow-out port.

3. The partition of claim 1, wherein
- the virtual plane is a plane having a width of 1.2 m and a height of 0.5 m at a position spaced 2.0 m from the blow-out port.

4. The partition of claim 1, wherein
- the virtual plane is a plane having a width of 1.8 m and a height of 0.5 m at a position spaced 4.0 m from the blow-out port.

5. The partition of claim 1, further comprising:
- a guide portion arranged to guide air in the air passage to the blow-out port so as to make a uniform wind velocity of air blown out through the blow-out port.

6. The partition of claim 1, further comprising:
- a rectifying member arranged to create a uniform flow direction of air blown out through the blow-out port.

7. The partition of claim 6, wherein
- the rectifying member is provided in the blow-out port, and the rectifying member has a porous portion formed with a plurality of holes, and
- the porous portion is formed such that an opening area of the holes gradually decreases from an intermediate position toward both ends of the air passage in the first direction.

8. The partition of claim 1, wherein
- the blow-out port is arranged along the air passage, and
- a sectional area of the air passage perpendicular to the first direction gradually decreases in the first direction.

9. The partition of claim 1, further comprising:
- a heat supply device configured to supply heat to a position close to a lower end of the casing.

10. The partition of claim 1, further comprising:
- a suction port through which air in an indoor space is sucked;

the air passage communicating the suction port and the blow-out port; and an air purification unit arranged in the air passage.

11. The partition of claim 10, wherein the air purification unit is arranged at the blow-out port.

12. The partition of claim 10, wherein the air purification unit is arranged at the suction port.

13. The partition of claim 1, wherein the blow-out port is arranged along a portion of the air passage extending in the first direction.

* * * * *